US010838336B2

(12) United States Patent
Yoshida et al.

(10) Patent No.: US 10,838,336 B2
(45) Date of Patent: Nov. 17, 2020

(54) FIXING DEVICE AND IMAGE FORMING APPARATUS THAT CONTROL POWER SUPPLY TO HEAT GENERATION MEMBERS

(71) Applicant: CANON KABUSHIKI KAISHA, Tokyo (JP)

(72) Inventors: Tsuguhiro Yoshida, Yokohama (JP); Kazuhiro Doda, Yokohama (JP); Yutaka Sato, Komae (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/822,426

(22) Filed: Mar. 18, 2020

(65) Prior Publication Data

US 2020/0301330 A1 Sep. 24, 2020

(30) Foreign Application Priority Data

Mar. 20, 2019 (JP) ..... 2019-053036

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/2064* (2013.01); *G03G 15/5004* (2013.01); *G03G 15/607* (2013.01); *G03G 15/80* (2013.01);
(Continued)

(58) Field of Classification Search
CPC ..... G03G 15/2053; G03G 15/2039; G03G 15/2064; G03G 15/5004; G03G 15/607; G03G 15/80; G03G 15/2042; G03G 15/205; G03G 2215/2035; G03G 2215/00721
See application file for complete search history.

(56) References Cited

U.S. PATENT DOCUMENTS 5,640,231 A 6/1997 Mitsui et al.
8,218,984 B2 * 7/2012 Ota ..... G03G 15/2042 399/33
2015/0037052 A1 * 2/2015 Muramatsu ..... G03G 15/2042 399/45

FOREIGN PATENT DOCUMENTS

JP 06348172 A 12/1994
JP 2001100558 A 4/2001
JP 2001255772 A 9/2001

OTHER PUBLICATIONS

Copending, unpublished U.S. Appl. No. 16/746,063, filed Jan. 17, 2020.

(Continued)

*Primary Examiner* — Hoang X Ngo
(74) *Attorney, Agent, or Firm* — Venable LLP

(57) ABSTRACT

The fixing device includes a film that is heated by a heater having at least two heat generation members, a pressure roller that forms a fixing nip portion together with the film, a heat generation member switching device that switches a power supply path for supplying power to the at least two heat generation members; and a CPU that controls the heat generation member switching device. In continuous printing on small-size sheets, the CPU causes, while a small-size sheet is held in the fixing nip portion N, the heat generation member switching device to start the operation of switching the power supply path so that power is supplied to one of the at least two heat generation members.

14 Claims, 9 Drawing Sheets

(52) U.S. Cl.
CPC ..... *G03G 2215/00721* (2013.01); *G03G 2215/00734* (2013.01); *G03G 2215/2035* (2013.01)

(56) References Cited

OTHER PUBLICATIONS

Copending, unpublished U.S. Appl. No. 16/781,109, filed Feb. 4, 2020.

* cited by examiner

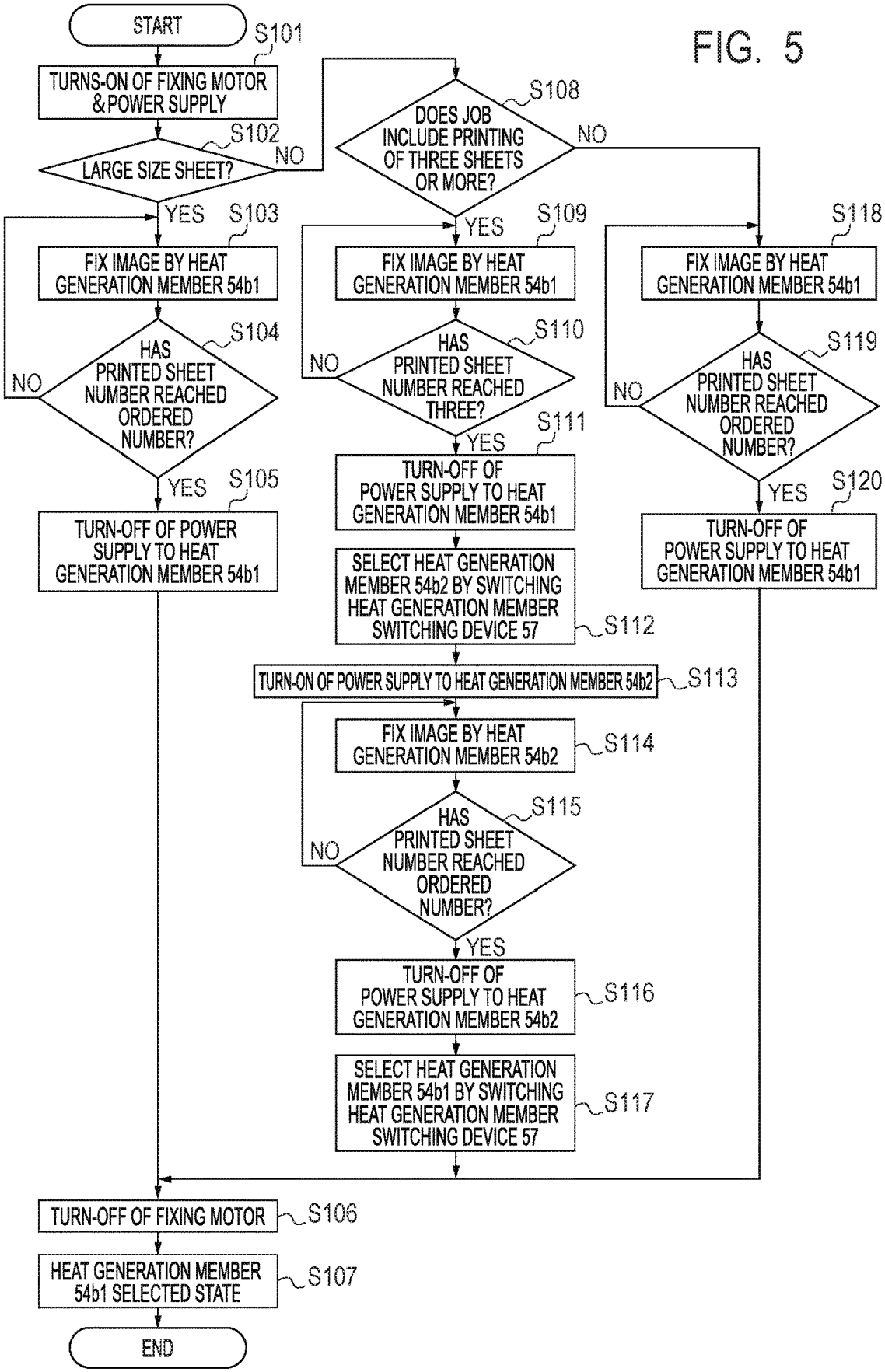
FIG. 5
START
S101
TURNS-ON OF FIXING MOTOR & POWER SUPPLY
S102
LARGE SIZE SHEET?
NO
YES
S103
FIX IMAGE BY HEAT GENERATION MEMBER 54b1
S104
HAS PRINTED SHEET NUMBER REACHED ORDERED NUMBER?
NO
YES
S105
TURN-OFF OF POWER SUPPLY TO HEAT GENERATION MEMBER 54b1
S108
DOES JOB INCLUDE PRINTING OF THREE SHEETS OR MORE?
NO
YES
S109
FIX IMAGE BY HEAT GENERATION MEMBER 54b1
S110
HAS PRINTED SHEET NUMBER REACHED THREE?
NO
YES
S111
TURN-OFF OF POWER SUPPLY TO HEAT GENERATION MEMBER 54b1
SELECT HEAT GENERATION MEMBER 54b2 BY SWITCHING HEAT GENERATION MEMBER SWITCHING DEVICE 57
S112
TURN-ON OF POWER SUPPLY TO HEAT GENERATION MEMBER 54b2
S113
FIX IMAGE BY HEAT GENERATION MEMBER 54b2
S114
S115
HAS PRINTED SHEET NUMBER REACHED ORDERED NUMBER?
NO
YES
TURN-OFF OF POWER SUPPLY TO HEAT GENERATION MEMBER 54b2
S116
SELECT HEAT GENERATION MEMBER 54b1 BY SWITCHING HEAT GENERATION MEMBER SWITCHING DEVICE 57
S117
S118
FIX IMAGE BY HEAT GENERATION MEMBER 54b1
S119
HAS PRINTED SHEET NUMBER REACHED ORDERED NUMBER?
NO
YES
S120
TURN-OFF OF POWER SUPPLY TO HEAT GENERATION MEMBER 54b1
TURN-OFF OF FIXING MOTOR
S106
HEAT GENERATION MEMBER 54b1 SELECTED STATE
S107
END

FIXING DEVICE AND IMAGE FORMING APPARATUS THAT CONTROL POWER SUPPLY TO HEAT GENERATION MEMBERS

BACKGROUND OF THE INVENTION

Field of the Invention

The present invention relates to a fixing device in an electrophotographic image forming apparatus such as a copier or a printer, and to an image forming apparatus having the fixing device.

Description of the Related Art

Some of conventional image forming apparatuses include a fixing device that includes multiple heat generation members of different lengths. For example, Japanese Patent Application Laid-Open No. 2001-100558 discloses a configuration in which a heat generation member to be powered is exclusively switched with a switching relay, so that a heat generation member having a length corresponding to the sheet size is selectively used to prevent a temperature increase in non-sheet-passing portions. A temperature increase in non-sheet-passing portions refers to a phenomenon of an increase in temperature in non-sheet-passing portions while fixing is performed on sheets P of a width narrower than the longitudinal length of the heat generation member. The non-sheet-passing portions are where the heat generation member does not contact the sheets P.

In the configuration in which a heat generation member to be powered is selected with a switching relay, it is desirable to switch the contact of the switching relay after stopping the power supplied to the heater in order to avoid contact sticking of the switching relay. In that case, however, if the heat generation member is switched during printing, the temperature of components of the fixing device decreases during the operation of switching the heat generation member. To address this, in continuous printing, the heat generation member may be switched in the interval between sheets (hereinafter referred to as a sheet interval). This can reduce the influence of the power stop during the operation of switching the heat generation member.

However, in an image forming apparatus with a high process speed, the sheet interval needs to be extended so that the switching relay can finish the contact switching operation within the sheet interval. This may reduce throughput.

SUMMARY OF THE INVENTION

An aspect of the present invention is a fixing device that prevents reduction in productivity in the operation of switching a power supply path to a heat generation member, and an image forming apparatus in which the fixing device is used.

Another aspect of the present invention is a fixing device including a heater having at least a first heat generation member and a second heat generation member whose length in a longitudinal direction shorter than the first heat generation member, a first rotary member configured to be heated by the heater, a second rotary member configured to form a nip portion together with the first rotary member, a switching unit configured to switch a power supply path for supplying power to the first heat generation member or the second heat generation member, and a first control unit configured to control the switching unit, wherein the fixing device is configured so that an unfixed toner image borne on a recording material is fixed with heat in the nip portion while the recording material passes through the nip portion, wherein in continuous printing on a first recording material whose length in the longitudinal direction is shorter than the second heat generation member, during a period when the first recording material is nipped in the nip portion, the first control unit controls the switching unit to start switching operation of switching the power supply path so that power is supplied to the second heat generation member.

A further aspect of the present invention is an image forming apparatus including an image forming unit configured to form an unfixed toner image on a recording material, and a fixing device including a heater having at least a first heat generation member and a second heat generation member whose length in a longitudinal direction shorter than the first heat generation member, a first rotary member configured to be heated by the heater, a second rotary member configured to form a nip portion together with the first rotary member, a switching unit configured to switch a power supply path for supplying power to the first heat generation member or the second heat generation member, and a first control unit configured to control the switching unit, wherein the fixing device is configured so that an unfixed toner image borne on a recording material is fixed with heat in the nip portion while the recording material passes through the nip portion, wherein in continuous printing on a first recording material whose length in the longitudinal direction is shorter than the second heat generation member, during a period when the first recording material is nipped in the nip portion, the first control unit controls the switching unit to start switching operation of switching the power supply path so that power is supplied to the second heat generation member, wherein the fixing device is configured to fix the unfixed toner image on the recording material.

Further features of the present invention will become apparent from the following description of exemplary embodiments with reference to the attached drawings.

BRIEF DESCRIPTION OF THE DRAWINGS

FIG. 5 is a flowchart of heat generation member switching control in the first to third embodiments.

DESCRIPTION OF THE EMBODIMENTS

Preferred embodiments of the present invention will now be described in detail in accordance with the accompanying drawings.

First Embodiment

[General Configuration]

Figure 1:
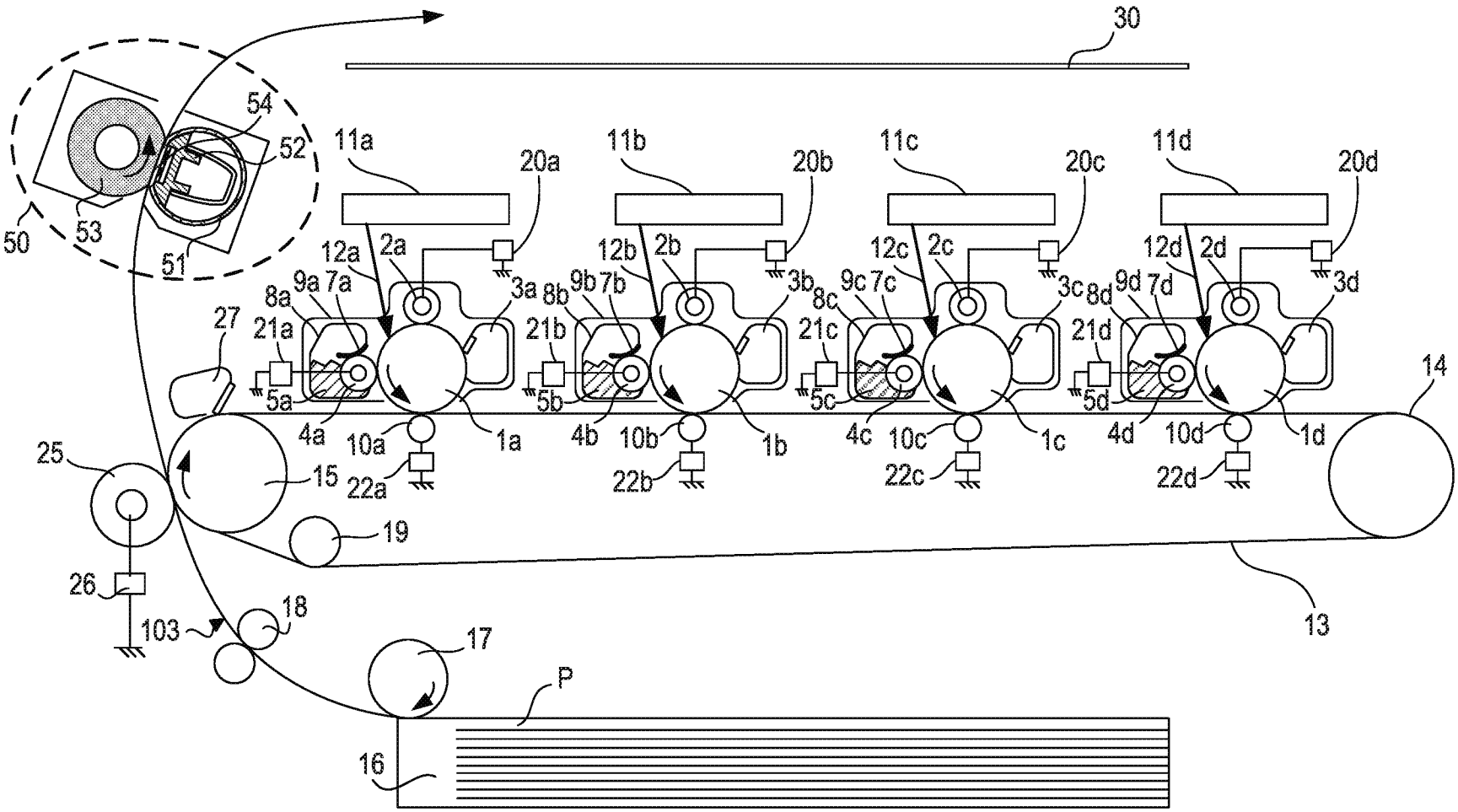
FIG. 1 is a configuration diagram of an image forming apparatus in first to third embodiments.

FIG. 1 is a configuration diagram illustrating an in-line color image forming apparatus, which is an exemplary image forming apparatus having a fixing device in a first embodiment. Operations of the electrophotographic color image forming apparatus will be described with reference to FIG. 1. First, second, third and fourth stations are stations for forming toner images in yellow (Y), magenta (M), cyan (C) and black (K), respectively.

In the first station, a photosensitive drum 1*a* serving as an image bearer is an OPC photosensitive drum. The photosensitive drum 1*a* has multiple layers of functional organic materials formed on a metal cylinder, including a carrier generation layer that generates electric charge when exposed to light, and a charge transport layer that transports the generated electric charge. The outermost layer has low electric conductivity and is substantially insulating. A charge roller 2*a* serving as a charge unit is in contact with the photosensitive drum 1*a*. As the photosensitive drum 1*a* rotates, the charge roller 2*a* is driven to rotate and uniformly charges the surface of the photosensitive drum 1*a*. One of a DC voltage, and a DC voltage on which an AC voltage is superimposed, is applied to the charge roller 2*a*. The photosensitive drum 1*a* is charged by the occurrence of discharge in small air gaps upstream and downstream in the rotation direction from a nip portion between the charge roller 2*a* and the surface of the photosensitive drum 1*a*. A cleaning unit 3*a* cleans off toner remaining on the photosensitive drum 1*a* after transfer, which will be described below. A development unit 8*a* includes a developing roller 4*a*, nonmagnetic single-component toner 5*a* and a developer application blade 7*a*. The photosensitive drum 1*a*, the charge roller 2*a*, the cleaning unit 3*a* and the development unit 8*a* constitute an integrated process cartridge 9*a* detachable from the image forming apparatus.

An exposure device 11*a* serving as an exposure unit includes a scanner unit performing scan with laser light via a polygon mirror, or includes a light-emitting diode (LED) array. The exposure device 11*a* irradiates the photosensitive drum 1*a* with a scanning beam 12*a* modulated according to an image signal. The charge roller 2*a* is connected to a high-voltage power supply for charge 20*a*, which is a unit for supplying voltage to the charge roller 2*a*. The developing roller 4*a* is connected to a high-voltage power supply for development 21*a*, which is a unit for supplying voltage to the developing roller 4*a*. A primary transfer roller 10*a* is connected to a high-voltage power supply for primary transfer 22*a*, which is a unit for supplying voltage to the primary transfer roller 10*a*. The first station is configured as described above, and so are the second, third and fourth stations. For the second, third and fourth stations, components having the same functions as in the first station are labeled with the same numerals followed by indexes b, c and d for the respective stations. In the following description, the indexes a, b, c and d will be omitted except in the cases where any specific station is described.

An intermediate transfer belt 13 is supported by three rollers serving as its tensioning members: a secondary transfer counter roller 15, a tension roller 14 and an auxiliary roller 19. Force in the direction of tensioning the intermediate transfer belt 13 is applied only to the tension roller 14 by a spring, so that appropriate tension force is maintained on the intermediate transfer belt 13. The secondary transfer counter roller 15 is driven to rotate by a main motor (not shown), thereby rotating the intermediate transfer belt 13 wound around the periphery. The intermediate transfer belt 13 moves in the forward direction (for example, the clockwise direction in FIG. 1) at the substantially same speed as the photosensitive drums 1*a* to 1*d* (which rotate in, for example, the counterclockwise direction in FIG. 1). While the intermediate transfer belt 13 rotates in the direction of the arrow (the clockwise direction), the primary transfer roller 10, disposed opposite to the photosensitive drum 1 with the intermediate transfer belt 13 in between, is driven to rotate with the movement of the intermediate transfer belt 13. The position where the photosensitive drum 1 and the primary transfer roller 10 abut on each other with the intermediate transfer belt 13 in between will be referred to as a primary transfer position. The auxiliary roller 19, the tension roller 14 and the secondary transfer counter roller 15 are electrically grounded. The primary transfer rollers 10*b* to 10*d* in the second to fourth stations have a similar configuration to the configuration of the primary transfer roller 10*a* in the first station and therefore will not be described.

Image forming operations of the image forming apparatus in the first embodiment will now be described. Upon receiving a print command in a standby state, the image forming apparatus starts image forming operations. Components such as the photosensitive drums 1 and the intermediate transfer belt 13 start to be rotated by the main motor (not shown) in the directions of the arrows at a predetermined process speed. The charge roller 2*a* with voltage applied by the high-voltage power supply for charge 20*a* uniformly charges the photosensitive drum 1*a*. The scanning beam 12*a* emitted by the exposure device 11*a* then forms an electrostatic latent image according to image information (also referred to as image data). The toner 5*a* in the development unit 8*a* is negatively charged by the developer application blade 7*a* and applied to the developing roller 4*a*. A predetermined development voltage is supplied to the developing roller 4*a* by the high-voltage power supply for development 21*a*. As the photosensitive drum 1*a* rotates, the electrostatic latent image formed on the photosensitive drum 1*a* reaches the developing roller 4*a*. The negatively charged toner attaches to the electrostatic latent image, which is visualized to form a toner image in a first color (for example, Y (yellow)) on the photosensitive drum 1*a*. The stations of the other colors M (magenta), C (cyan) and K (black) (the process cartridges 9*b* to 9*d*) also operate in a similar manner. Electrostatic latent images are formed by exposure on the respective photosensitive drums 1*a* to 1*d* while write signals from a controller (not shown) are delayed by a certain time corresponding to the distance between the primary transfer positions for the respective colors. A DC high voltage with the polarity opposite to the polarity of the toner is applied to the primary transfer rollers 10*a* to 10*d*. Through the above process, the toner images are sequentially transferred onto the intermediate transfer belt 13 (this will hereinafter be referred to as primary transfer), resulting in a multilayer toner image formed on the intermediate transfer belt 13.

Thereafter, timed to the formation of the toner image, a sheet P serving as a recording material and stacked in a cassette 16 is fed (picked up) by a sheet feeding roller 17 driven to rotate by a sheet feeding solenoid (not shown). The fed sheet P is conveyed by a conveyance roller to registration rollers 18. A registration sensor 103 is disposed downstream from the registration rollers 18. The registration sensor 103 detects the "presence" of the sheet P upon arrival of the leading edge of the sheet P and detects the "absence" of the sheet P upon passage of the trailing edge of the sheet P. In synchronization with the toner image on the intermediate transfer belt 13, the sheet P is conveyed by the registration rollers 18 to a transfer nip portion, which is a contact portion between the intermediate transfer belt 13 and a secondary transfer roller 25. A voltage with the polarity opposite to the polarity of the toner is applied to the secondary transfer roller 25 by a high-voltage power supply for secondary transfer 26. The four-color multilayer toner image borne on the intermediate transfer belt 13 is collectively transferred onto the sheet P (the recording material) (this will hereinafter be referred to as secondary transfer). The components (for example, the photosensitive drums 1) that contribute to the formation of the unfixed toner image on the sheet P function as an image forming unit. After the secondary transfer, toner remaining on the intermediate transfer belt 13 is cleaned off by the cleaning unit 27. The sheet P subjected to the secondary transfer is conveyed to a fixing device 50 serving as a fixing unit, in which the toner image is fixed onto the sheet P. The sheet P is ejected as an image-formed product (a printed sheet or a copy) onto an ejection tray 30. A film 51, a nip forming member 52, a pressure roller 53 and a heater 54 in the fixing device 50 will be described below.

The print mode in which images are continuously printed on multiple sheets P will hereinafter be referred to as continuous printing or a continuous job. In continuous printing, a sheet interval refers to the interval between the trailing edge of a sheet P (hereinafter referred to as a preceding sheet) printed earlier and the leading edge of a sheet P (hereinafter referred to as a following sheet (a second recording material)) to be printed following the preceding sheet. In continuous printing in the first embodiment, each sheet P and the corresponding toner image on the intermediate transfer belt 13 are synchronously conveyed with a sheet interval of 30 mm, for example, and subjected to printing.

[Block Diagram of Image Forming Apparatus]

Figure 2:
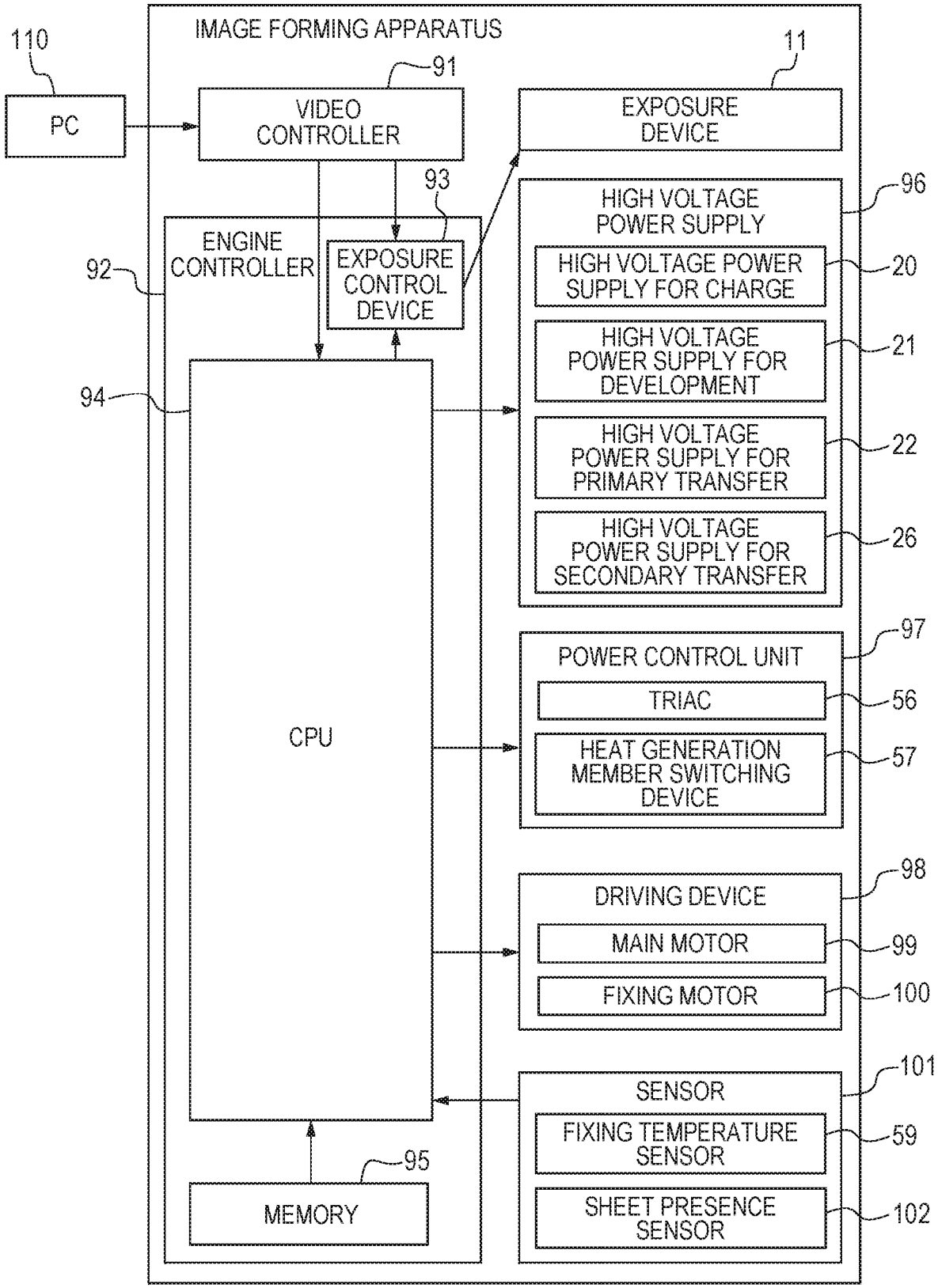
FIG. 2 is a block diagram of the image forming apparatus in the first to third embodiments.

FIG. 2 is a block diagram for describing operations of the image forming apparatus. With reference to FIG. 2, print operations of the image forming apparatus will be described. A PC 110 serving as a host computer is responsible for issuing a print command to a video controller 91 in the image forming apparatus and transferring image data on a printed image to the video controller 91.

The video controller 91 serving as a second control unit converts the image data received from the PC 110 into exposure data and transfers the exposure data to an exposure control device 93 in an engine controller 92. The exposure control device 93 is controlled by a CPU 94 to turn on/off the exposure data and to control the exposure devices 11. The CPU 94 serving as a first control unit starts an image forming sequence upon receiving the print command.

The engine controller 92 includes the CPU 94 and a memory 95, and performs preprogrammed operations. A high-voltage power supply 96 includes the above-described high-voltage power supplies for charge 20, high-voltage power supplies for development 21, high-voltage power supplies for primary transfer 22 and high-voltage power supply for secondary transfer 26. A power control unit 97 includes a bidirectional thyristor (hereinafter referred to as a triac) 56 and a heat generation member switching device 57. The heat generation member switching device 57 is a switching unit that switches a heat generation member by switching a power supply path used for supplying power. The power control unit 97 selects a heat generation member that is to generate heat in the fixing device 50, and determines the amount of power to be supplied. In the first embodiment, the heat generation member switching device 57 is a Form C contact relay, for example. A driving unit 98 includes a main motor 99 and a fixing motor 100. Sensors 101 include a fixing temperature sensor 59 that detects the temperature of the fixing device 50, and a sheet presence sensor 102 that has a flag and detects the presence or absence of a sheet P. The detection results of the sensors 101 are sent to the CPU 94. The sheet presence sensor 102 may include the registration sensor 103. The CPU 94 obtains the detection results of the sensors 101 in the image forming apparatus and controls the exposure devices 11, the high-voltage power supply 96, the power control unit 97 and the driving unit 98. The CPU 94 thus forms an electrostatic latent image, transfers a developed toner image, and fixes the toner image onto a sheet P, thereby controlling the image forming process in which exposed data is printed as a toner image on a sheet P. Image forming apparatuses to which the present invention is applicable are not limited to those configured as described for FIG. 1, but may be any image forming apparatus that can print on sheets P of different widths and that includes the fixing device 50 having the heater 54 to be described below.

[Fixing Device]

Figure 3:
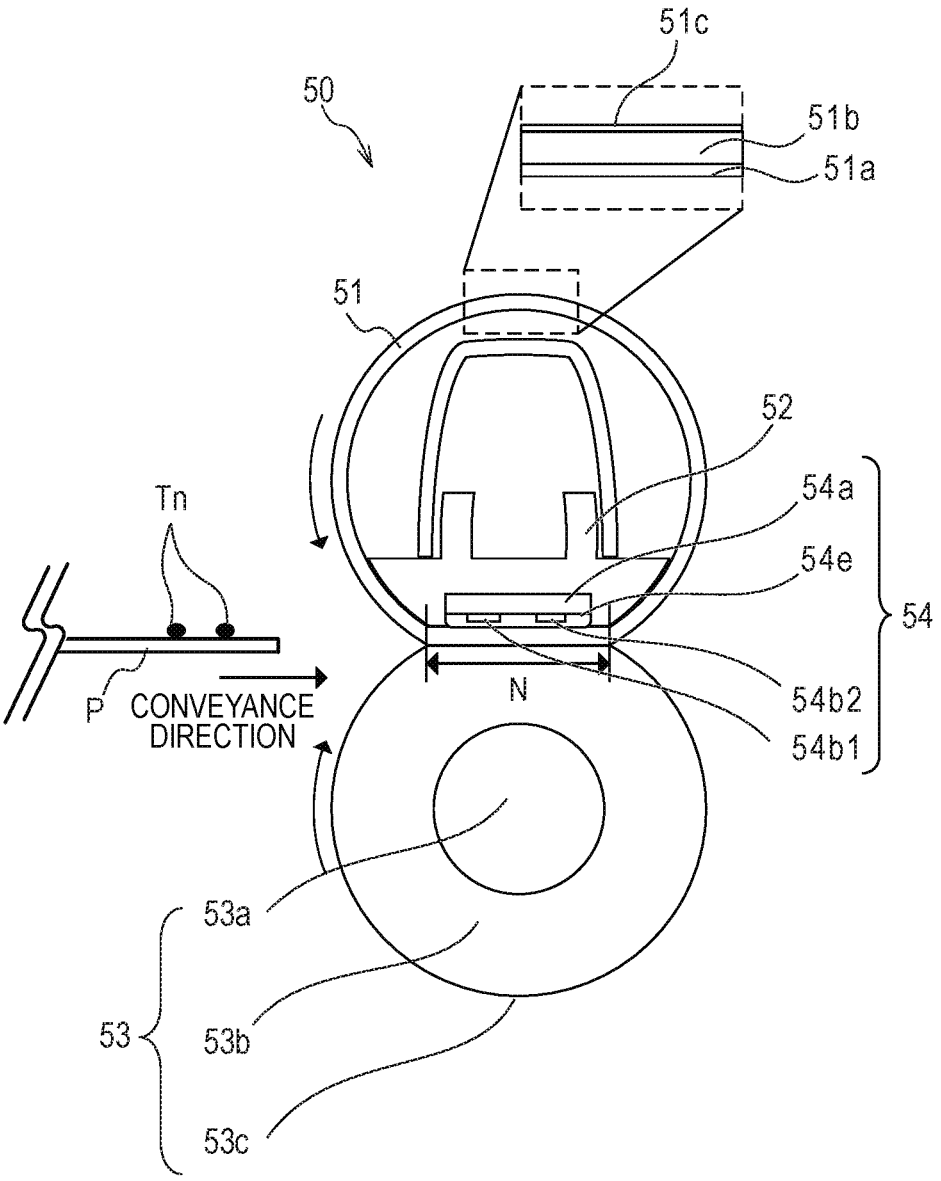
FIG. 3 is a schematic sectional view of a fixing device around the longitudinal center in the first to third embodiments.

The configuration of the fixing device 50 in the first embodiment will now be described with reference to FIG. 3. A longitudinal direction refers to the direction in which the rotation axis of the pressure roller 53 extends substantially orthogonally to the conveyance direction (to be described below) of the sheets P. A width refers to the length of a sheet P in the direction (the longitudinal direction) substantially orthogonal to the conveyance direction. FIG. 3 is a schematic sectional view of the fixing device 50.

In FIG. 3, a sheet P bearing an unfixed toner image Tn is conveyed from the left toward the right. While being conveyed, the sheet P is heated in a nip portion (hereinafter referred to as a fixing nip portion N), resulting in the toner image Tn fixed onto the sheet P. The fixing device 50 in the first embodiment includes: the cylindrical film 51; the nip forming member 52 that holds the film 51; the pressure roller 53 that forms the fixing nip portion N together with the film 51; and the heater 54 for heating the sheets P.

The film 51, which is a first rotary member, is a fixing film serving as a heating rotary member. In the first embodiment, the film 51 includes three layers: a base layer 51*a*, an elastic layer 51*b* and a release layer 51*c*. The base layer 51*a* is made of polyimide, for example. On the base layer 51*a* are the elastic layer 51*b* made of silicone rubber and the release layer 51*c* made of PFA. The base layer 51*a* has a thickness of 50 μm, the elastic layer 51*b* has a thickness of 200 μm, and the release layer 51*c* has a thickness of 20 μm. The film 51 has an outside diameter of 18 mm. The outer periphery of the film 51 will be denoted as an outer periphery M. Grease is applied to the inner surface of the film 51 in order to reduce friction force produced on the film 51 against the nip forming member 52 and the heater 54 due to the rotation of the film 51.

The nip forming member 52 is responsible for internally guiding the film 51 and for forming the fixing nip portion N together with the pressure roller 53 through the film 51. The nip forming member 52 has rigidity, heat resistance and heat insulation, and is formed of a material such as a liquid crystal polymer. The film 51 is fitted onto the nip forming member 52. The pressure roller 53, which is a second rotary member, is a roller serving as a pressure rotary member. The pressure roller 53 includes a metal core 53*a* made of steel, an elastic layer 53*b* made of silicone rubber, and a release layer 53*c* made of a PFA material. The metal core 53*a* has a diameter of 12 mm, for example. The elastic layer 53*b* has a thickness of 3 mm, for example. The release layer 53*c* has a thickness of 50 μm, for example. The pressure roller 53 has a diameter (an outside diameter) of 20 mm, for example. The outer periphery of the pressure roller 53 will be denoted as an outer periphery K. The pressure roller 53 is rotatably held at both ends and is driven to rotate by the fixing motor 100 (see FIG. 2). With the rotation of the pressure roller 53, the film 51 is rotated. The heater 54 serving as a heating member is held by the nip forming member 52 to be in contact with the inner surface of the film 51. A substrate 54*a*, heat generation members 54*b*1 and 54*b*2, and a protective glass layer 54*e* will be described below.

(Heater)

Figure 4A:
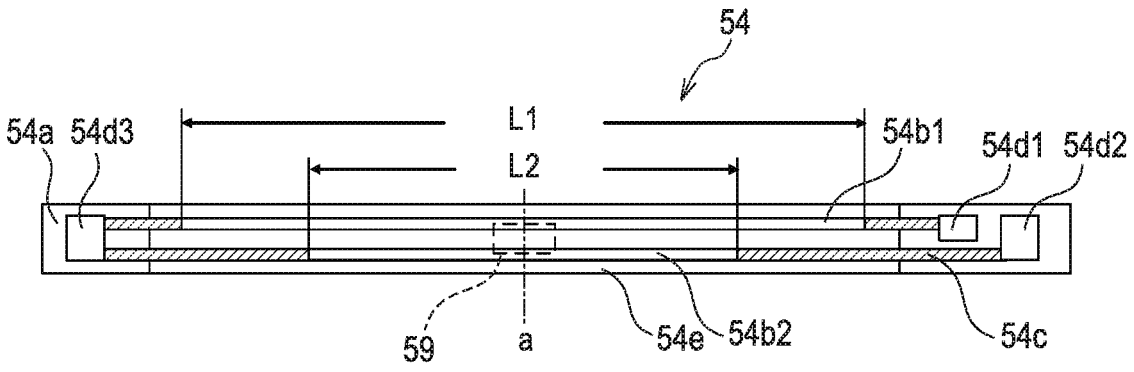
FIGS. 4A, 4B and 4C are schematic diagrams of a heater and a schematic diagram of a power control circuit in the first to third embodiments.
Figure 4B:
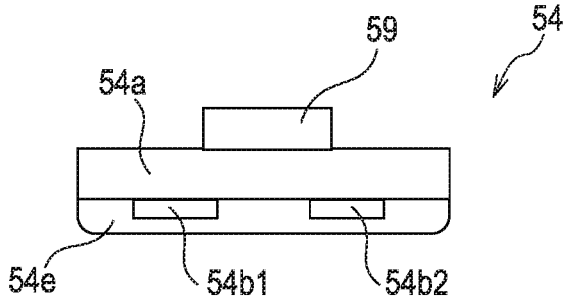

The heater 54 will be described in detail with reference to FIGS. 4A and 4B. The heater 54 includes the substrate 54*a* made of alumina, the heat generation members 54*b*1 and 54*b*2 made of silver paste, a conductor 54*c*, contacts 54*d*1 to 54*d*3, and the protective glass layer 54*e* made of glass. The heat generation members 54*b*1 and 54*b*2, the conductor 54*c*, and the contacts 54*d*1 to 54*d*3 are formed on the substrate 54*a*. The protective glass layer 54*e* is further formed on these components to ensure insulation between the film 51 and the heat generation members 54*b*1 and 54*b*2. The heat generation members 54*b*1 and 54*b*2 may be referred to as a heat generation member 54*b* without distinction. The substrate 54*a* has a length (a longitudinal length) of 250 mm, a width (a lateral length) of 7 mm, and a thickness of 1 mm, for example. The heat generation member 54*b* and the conductor 54*c* have a thickness of 10 μm, for example. The contacts 54*d* have a thickness of 20 μm, for example. The protective glass layer 54*e* has a thickness of 50 μm, for example.

The heat generation member 54*b*1 serving as a first heat generation member and the heat generation member 54*b*2 serving as a second heat generation member are different in longitudinal length (hereinafter also referred to as size). The heater 54 in the first embodiment has at least the heat generation members 54*b*1 and 54*b*2. Specifically, the heat generation member 54*b*1 has the longitudinal length L1 and the heat generation member 54*b*2 has the longitudinal length L2, and the lengths L1 and L2 are in the relationship L1>L2. The longitudinal length L1 of the heat generation member 54*b*1 is such that L1=222 mm, for example. The longitudinal length L2 of the heat generation member 54*b*2 is such that L2=185 mm, for example. The heat generation member 54*b*1 is electrically connected to the contacts 54*d*1 and 54*d*3 through the conductor 54*c*. The heat generation member 54*b*2 is electrically connected to the contacts 54*d*2 and 54*d*3 through the conductor 54*c*. That is, the contact 54*d*3 is a shared contact connected to both heat generation members 54*b*1 and 54*b*2.

The fixing temperature sensor 59 is located on the surface of the substrate 54*a* opposite to the protective glass layer 54*e*. The fixing temperature sensor 59 is provided at the longitudinal center "a" (a dashed and single-dotted line) of the heat generation members 54*b*1 and 54*b*2 and pressed against the substrate 54*a* at 200 gf (gram weight). The fixing temperature sensor 59 is a thermistor, for example, and detects the temperature of the heater 54 and outputs the detection result to the CPU 94. Based on the detection result of the fixing temperature sensor 59, the CPU 94 controls the temperature at which the fixing is performed. In the first embodiment, the power control unit 97 controls the temperature of the fixing device 50 to be 180° C., for example.

(Power Control Unit)

Figure 4C:
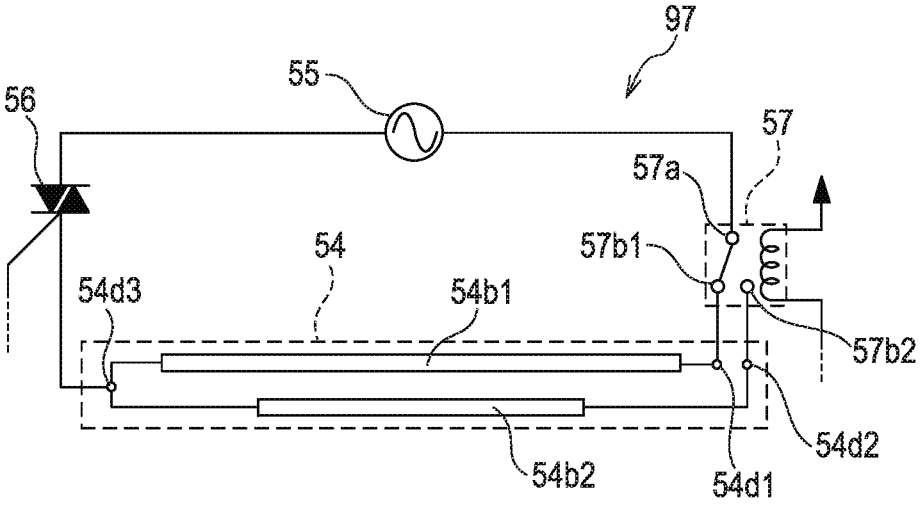

FIG. 4C is a schematic diagram of the power control unit 97 serving as a control circuit of the fixing device 50. The power control unit 97 of the fixing device 50 includes the heat generation members 54*b*1 and 54*b*2 (the heater 54), an AC power supply 55, the triac 56, and the heat generation member switching device 57. The triac 56 is brought into conduction (turned on) when supplying power from the AC power supply 55 to the heat generation member 54*b*1 or 54*b*2 through a power supply path. The triac 56 is brought out of conduction (turned off) when stopping supplying power from the AC power supply 55 to the heat generation member 54*b*1 or 54*b*2. The triac 56 functions as a connection unit that supplies power or stops supplying power to the heater 54. Based on the temperature information detected by the fixing temperature sensor 59, the CPU 94 calculates the power necessary for controlling the temperature of the heat generation member 54*b*1 or 54*b*2 to be the target temperature (for example, 180° C. as mentioned above) and controls the triac 56 to be in conduction or out of conduction.

The heat generation member switching device 57 in the first embodiment is a Form C contact relay, for example. Specifically, the heat generation member switching device 57 has a contact 57*a* connected to the AC power supply 55, a contact 57*b*1 connected to the contact 54*d*1, and a contact 57*b*2 connected to the contact 54*d*2. Under the control of the CPU 94, the heat generation member switching device 57 assumes either the state in which the contact 57*a* is connected to the contact 57*b*1 or the state in which the contact 57*a* is connected to the contact 57*b*2. The switching of the heat generation member switching device 57 causes the power supply path to be switched between the power supply path for supplying power to the heat generation member 54*b*1 and the power supply path for supplying power to the heat generation member 54*b*2. This exclusively determines which of the heat generation members 54*b*1 and 54*b*2 receives power supply. That is, the heat generation member switching device 57 switches the heater 54 between the heat generation members 54*b*1 and 54*b*2. Hereinafter, the switching of the power supply path by the heat generation member switching device 57 may also be expressed as switching to (or selecting) one of the heat generation member 54*b*1 and 54*b*2. The heat generation member switching device 57 performs the switching in response to receiving a signal from the CPU 94. For preventing contact sticking of the heat generation member switching device 57 that is a Form C contact relay, the heat generation member switching device 57 performs switching while the triac 56 is out of conduction (while power supply to the heat generation member 54*b*1 or 54*b*2 is stopped). In the first embodiment, it took 200 ms for the heat generation member switching device 57 to finish switching after the CPU 94 outputs a switching signal.

A sheet P longitudinally narrower than the heat generation member 54*b*2 will be referred to as a small-size sheet, which is a first recording material. A sheet P longitudinally wider than the heat generation member 54*b*2 will be referred to as a large-size sheet, which is a third recording material. In printing on large-size sheets, fixing uses the heat generation member 54*b*1. In printing on small-size sheets, fixing uses the heat generation member 54*b*1 and the heat generation member 54*b*2 alternately switched according to the number of printed sheets from the viewpoint of preventing deformation of the film 51. In the first embodiment, the operation of switching the heat generation member 54*b* in continuous printing is performed in continuous printing on small-size sheets, for example.

[Continuous Printing on Large-Size Sheets and Continuous Printing on Small-Size Sheets]

Exemplary cases of continuous printing on large-size sheets and continuous printing on small-size sheets will be described with reference to FIG. 5. FIG. 5 is a flowchart illustrating the control of switching the heat generation member 54*b* in the first embodiment. In the first embodiment, in the end of print operations, the heat generation member switching device 57 is used to switch to the state capable of supplying power to the longitudinally widest heat generation member 54*b*1, irrespective of the longitudinal width of the sheets P, and the printing is terminated. Therefore, whenever print operations are started, the heat generation member 54*b*1 is already selected by the heat generation member switching device 57 and is ready to generate heat.

First, as an operation common to continuous printing on large-size sheets and continuous printing on small-size sheets, the CPU 94 starts a process beginning at step (hereinafter denoted as S) 101 upon receiving a print instruction (a print command). As described above, when the CPU 94 receives the print instruction, the power supply path is already switched by the heat generation member switching device 57 so that power is supplied to the heat generation member 54*b*1. At S101, the CPU 94 starts up (turns on power supply to) the fixing motor 100 to start rotation of the pressure roller 53, and causes the triac 56 to start (turn on) supplying power to the heat generation member 54*b*1 of the heater 54. This causes the film 51 to be heated while being driven to rotate. At S102, the CPU 94 determines whether the sheets P to be printed are large-size sheets. If the CPU 94 determines that the sheets P to be printed are large-size sheets at S102, the process proceeds to S103. At S103, the CPU 94 performs fixing with the heat generation member 54*b*1. That is, when continuous printing on large-size sheets is started, the operation of switching the heat generation member 54*b* is not performed.

At S104, the CPU 94 determines whether the number of printed sheets P has reached the number specified by the print instruction. The CPU 94 has a counter (not shown) that counts the number of printed sheets, and manages the number of printed sheets with the counter. If the CPU 94 determines that the specified number of sheets to be printed has not been reached at S104, the process returns to S103.

If the CPU 94 determines that the sheets P to be printed are not large-size sheets but small-size sheets at S102, the process proceeds to S108. At S108, the CPU 94 determines whether the received print job specifies printing on three or more sheets P. If the CPU 94 determines that the received print job specifies printing on three or more sheets P at S108, the process proceeds to S109. At S109, the CPU 94 performs fixing with the heat generation member 54*b*1. At S110, the CPU 94 determines whether the number of printed sheets has reached three. If the CPU 94 determines that the number of printed sheets has not reached three at S110, the process returns to S109. If the CPU 94 determines that the number of printed sheets has reached three at S110, the process proceeds to S111.

At S111, the CPU 94 causes the triac 56 to stop (turn off) the power supply to the heat generation member 54*b*1. At S112, the CPU 94 causes the heat generation member switching device 57 to switch the power supply path so that power is supplied to the heat generation member 54*b*2 (select the heat generation member 54*b*2). At S113, the CPU 94 causes the triac 56 to start (turn on) power supply to the heat generation member 54*b*2. That is, if continuous printing is performed on three or more small-size sheets, the heat generation member 54*b*1 is used for the first three sheets P. Between the third and fourth sheets P, an operation is performed for switching the heat generation member 54*b* from the heat generation member 54*b*1 to the heat generation member 54*b*2. In this manner, irrespective of the size of the sheets P, the fixing operation is performed with the heat generation member 54*b*1 for the first several (a predetermined number of) sheets (in the above example, the first three small-size sheets). The reason for stopping the power supply by the triac 56 here is to prevent contact sticking of the heat generation member switching device 57 that is a Form C contact relay. Although the heat generation member 54*b* is switched between the third and fourth sheets P in the first embodiment, this is exemplary and not limiting. For example, which of the successive sheet intervals is used to switch the heat generation member 54*b* after the start of printing can be set according to various conditions, including the type of the sheets P and the resistance of the heat generation member 54*b*.

(Film Deformation)

As above, the fixing is performed with the longitudinally wider heat generation member 54*b*1 for the first several sheets even if the sheets are small-size sheets. This is for uniformly transferring heat across the longitudinal length of the fixing nip portion N to uniformly soften the grease on the inner surface of the film 51, thereby preventing deformation of the film 51.

The reason why the film 51 may be deformed will be described in detail. If the fixing operation is started with the longitudinally narrower heat generation member 54*b*2 while the fixing device 50 is still cold, a difference in grease viscosity arises between the longitudinally inner area and the longitudinally outer areas with respect to the heat generation member 54*b*2. This applies twisting force to the film 51, which may then be deformed. In the longitudinal area where the heat generation member 54*b*2 exists in the fixing nip portion N, the temperature rises due to the power supplied to the heat generation member 54*b*2. This reduces the grease viscosity, so that the sliding load between the film 51 and the heater 54 decreases. By contrast, in the longitudinal areas where not the heat generation member 54*b*2 but only the heat generation member 54*b*1 exists in the fixing nip portion N, the temperature in the fixing nip portion N does not significantly rise while power is being supplied to the heat generation member 54*b*2. This causes the grease viscosity to be maintained high, so that the sliding load remains high and does not decrease. Consequently, force is applied to the film 51 when the film 51 is driven to rotate by the pressure roller 53. This force creates a difference in the rotation speed of the film 51 between the longitudinal center portion where the heat generation member 54*b*2 exists and both longitudinal end portions where the heat generation member 54*b*2 does not exist. If the film 51 is not sufficiently strong, the film 51 may be twisted and deformed. With the configuration in the first embodiment, fixing in continuous printing for small-size sheets uses the heat generation member 54*b*1 for the first three sheets and uses the heat generation member 54*b*2 for the fourth and following sheets. With this configuration, deformation of the film 51 was not observed.

Returning to the description of FIG. 5, if the sheets are large-size sheets, fixing in the printing on all the sheets P is performed with the heat generation member 54*b*1 in the processing up to S104. If the CPU 94 determines that the specified number of sheets to be printed has been reached at S104, the process proceeds to S105. After finishing the printing, at S105, the CPU 94 causes the triac 56 to stop (turn off) the power supply to the heat generation member 54*b*1. At S106, the CPU 94 stops (turns off the power supply to) the fixing motor 100. At S107, the CPU 94 has the heat generation member 54*b*1 selected by the heat generation member switching device 57, and the process terminates.

If the sheets are small-size sheets and if the CPU 94 determines that the specified number of sheets to be printed is less than three at S108, the process proceeds to S118. At S118, the CPU 94 performs fixing with the heat generation member 54*b*1. At S119, the CPU 94 determines whether the specified number of sheets to be printed (i.e., the number less than three) has been reached. If the CPU 94 determines that the specified number of sheets to be printed has not been reached at S119, the process returns to S118. If the CPU 94 determines that the specified number of sheets to be printed has been reached at S119, the process proceeds to S120. Thus, if the specified number of sheets to be printed is less than three, fixing on all the sheets are performed with the heat generation member 54*b*1 irrespective of the width of the sheets P. After finishing the printing, at S120, the CPU 94 causes the triac 56 to stop (turn off) the power supply to the heat generation member 54*b*1, and the process proceeds to S106.

Processing for the fourth and following sheets in the case of printing on three or more small-size sheets will be described. At S114, the CPU 94 performs fixing on the sheet P with the heat generation member 54*b*2. At S115, the CPU 94 determines whether the specified number of sheets to be printed has been reached. If the CPU 94 determines that the specified number of sheets to be printed has not been reached at S115, the process returns to S114. If the CPU 94 determines that the specified number of sheets to be printed has been reached at S115, the process proceeds to S116. At S116, the CPU 94 causes the triac 56 to stop (turn off) the power supply to the heat generation member 54*b*2. At S117, the CPU 94 causes the heat generation member switching device 57 to switch the power supply path so that power is supplied to the heat generation member 54*b*1 (select the heat generation member 54*b*1), and the process proceeds to S106. The processing at S116 and S117 in the first embodiment is performed during, for example, a postprocessing operation (hereinafter also referred to as post-rotation) of the fixing device 50 in which the fixing motor 100 is still driven after the completion of the printing.

The first embodiment is characterized in that, if the operation of switching the heat generation member 54*b* is performed during continuous printing, the operation of switching the heat generation member 54*b* is started when a margin area at the trailing edge of a sheet P is in the fixing nip portion N (is passing through the fixing nip portion N). Margin areas refer to areas where no toner image is formed irrespective of image data to be printed, for example areas of 5 mm at the top, bottom, right, and left of the sheet P. The top and bottom of the sheet P correspond to the leading edge and the trailing edge, respectively, in the conveyance direction of the sheet P. The right and left of the sheet P correspond to the right edge and the left edge, respectively, in the width direction of the sheet P. The operation of switching the heat generation member 54*b* refers to the process from when the CPU 94 sends a signal that instructs the triac 56 to stop the power to when the heat generation member switching device 57 finishes switching and the triac 56 starts supplying power to the heat generation member 54*b*.

[Heat Generation Member Switching Operation]

Figure 6A:
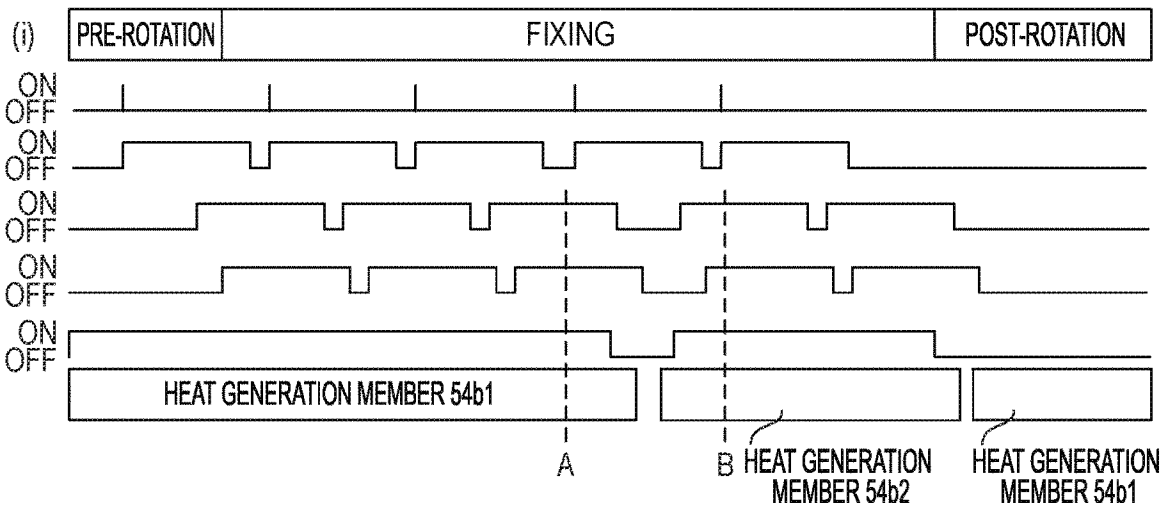
FIGS. 6A and 6B are timing charts of the heat generation member switching control in the first embodiment.
Figure 6B:
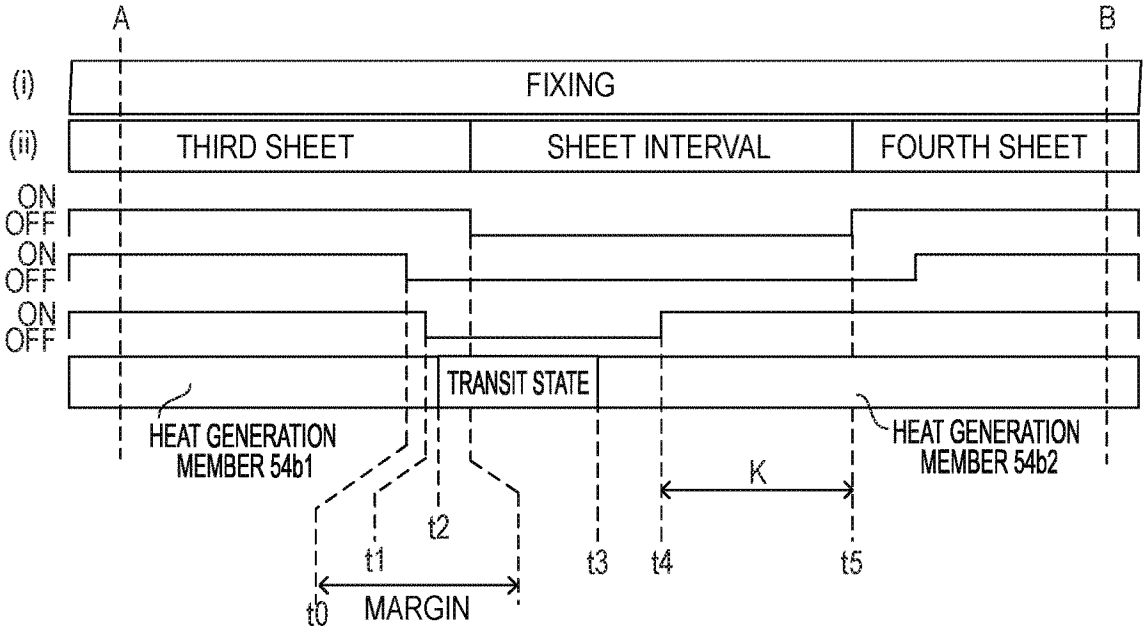

Details of the heat generation member switching operation in the first embodiment will be described with reference to FIGS. 6A and 6B. In the first embodiment, the operation of switching the heat generation member 54*b* is started while the preceding sheet is being held by and conveyed through the fixing nip portion N. In particular, in the first embodiment, the operation of switching the heat generation member 54*b* is started where the margin area at the trailing edge of the preceding sheet begins. FIG. 6A is a timing chart of continuous printing on five B5 sheets (182 mm in width and 257 mm in length) that are small-size sheets P. In FIG. 6A, (i) illustrates the operation state (such as pre-rotation, fixing, and post-rotation), (ii) illustrates a TOP signal, and (iii) illustrates the image forming operation. Further, (iv) illustrates the detection result of the registration sensor 103, (v) illustrates the state of the fixing nip portion N, (vi) illustrates the state of the triac 56, and (vii) illustrates the state of the heat generation member switching device 57. FIG. 6B is a detailed timing chart of the operation of switching the heat generation member 54*b*, showing the enlarged A-B section in FIG. 6A. In FIG. 6B, (i) illustrates the operation state (such as fixing), and (ii) illustrates the conveyance state of the sheets P (the ordinal position of each sheet P, or the sheet interval). Further, (iii) illustrates the presence or absence of a sheet P in the fixing nip portion N, (iv) illustrates whether an image area is in the fixing nip portion N, (v) illustrates the state of the triac 56, and (vi) illustrates the state of the heat generation member switching device 57.

In FIGS. 6A and 6B, the registration sensor 103, the fixing nip portion N, the triac 56, and the heat generation member switching device 57 each indicate their states as follows. If the registration sensor 103 is in turn-on state, the registration sensor 103 is detecting a sheet P being held by and conveyed through the registration rollers 18 (hereinafter also referred to as a registration unit) upstream from the registration sensor 103. If the fixing nip portion N (sheet) is in turn-on state, a sheet P is being held by and conveyed through the fixing nip portion N. It is to be noted that (v) in FIG. 6A also indicates whether a sheet P is being held by and conveyed through the fixing nip portion N. If the fixing nip portion N (image area) is in turn-on state, the area on a sheet P where an image has been formed is being held by and conveyed through the fixing nip portion N. In the conveyance direction, the top margin area starts at the leading edge of a sheet P, and the image area starts at the end of the top margin area. Also, in the conveyance direction, the bottom margin area starts at the end of the image area of the sheet P, and the bottom margin area ends at the trailing edge of the sheet P. If the triac 56 is in turn-on state, power is being supplied to one of the heat generation member 54*b*1 and 54*b*2. The heat generation member switching device 57 indicates which of the two states is being selected: the state in which the contact 57*a* is connected to the contact 57*b*1 to supply power to the heat generation member 54*b*1, or the state in which the contact 57*a* is connected to the contact 57*b*2 to supply power to the heat generation member 54*b*2. "Transit state" indicates that the contact of the heat generation member switching device 57 is in the process of being switched between the contacts 57*b*1 and 57*b*2.

In the first embodiment, as shown in FIG. 6B, in continuous printing on four or more small-size sheets, the heat generation member 54*b* is switched from the heat generation member 54*b*1 to the heat generation member 54*b*2 between the third and fourth sheets (the sheet interval). For the operation of switching the heat generation member 54*b*, the sheet interval is extended by counting the number of sheets to be printed in the continuous printing and extending the interval between image top signals (TOP signals) corresponding to the leading edges of the third and fourth sheets P. In the first embodiment, the following control is performed after the beginning (the start position) of the margin area at the trailing edge of the third sheet P reaches the most downstream position of the fixing nip portion N in the conveyance direction (hereinafter referred to as the most downstream position) (after time t0). At time t1, the power supply to the heat generation member 54*b*1 is stopped with the triac 56 in response to a signal from the CPU 94. Time t1 is determined with reference to the TOP signal. In the first embodiment, thus, the power supply is stopped with the triac 56 after the beginning of the margin area at the trailing edge of the third sheet P reaches the most downstream position of the fixing nip portion N. However, stopping the power supply and the reaching of the margin area may be simultaneous. That is, time t0 and time t1 may be the same time point.

At time t2, which is 20 ms after time t1, the CPU 94 sends a signal for switching the heat generation member 54*b* to the heat generation member switching device 57. At time t3, which is 200 ms after time t2, the heat generation member switching device 57 finishes switching from the heat generation member 54*b*1 to the heat generation member 54*b*2. At time t4, which is 100 ms after time t3, power supply to the generation member 54*b*2 is started with the triac 56. Here, the interval of 100 ms is provided between times t3 and t4 in order to ensure avoiding contact sticking of the heat generation member switching device 57 even if an error occurs in the operation timing of the heat generation member switching device 57. Therefore, 320 ms is necessary for starting the operation of switching from one heat generation member 54*b* and for starting power supply to the other heat generation member 54*b*. During this period, the sheet P is conveyed 32 mm with the process speed of the first embodiment (100 mm/s). The distance the sheet P is conveyed between times t1 and t4 will be referred to as a switching distance I. The switching distance I is 32 mm in the first embodiment.

At time t5, at which both the film 51 and the pressure roller 53 finish one rotation from time t4, the leading edge of the fourth sheet P enters the fixing nip portion N ((ii) in FIG. 6B). In the first embodiment, because the pressure roller 53 has a larger outside diameter than the film 51, the period between times t4 and t5 is the time it takes to travel the distance corresponding to the outer periphery K (≈64.8 mm) of the pressure roller 53, i.e., 0.648 s (=64.8 mm±100 mm/s).

As above, the first embodiment is configured to start the operation of switching the heat generation member 54*b* in the margin area at the trailing edge of the preceding sheet. The configuration in the first embodiment can increase productivity while maintaining fixability of toner onto the preceding sheet, compared to a configuration in which the operation of switching the heat generation member 54*b* is started after the preceding sheet (the trailing edge thereof) passes through the fixing nip portion N. In the first embodiment, four or more printed small-size sheets can be output 50 ms faster by starting the operation of switching the heat generation member 54*b* in the margin area at the trailing edge of the preceding sheet.

The period corresponding to one rotation of the film 51 and the pressure roller 53 is provided before the following sheet enters the fixing nip portion N. This is for preventing image degradation due to a decrease in the temperature of the film 51 and the pressure roller 53 during the operation of switching the heat generation member 54*b*. In the image forming apparatus with a process speed faster than a certain degree as in the first embodiment, the heated portion of the film 51 passes through the fixing nip portion N before the heat provided by the heater 54 to the inner surface of the film 51 appears on the outer surface of the film 51. The heat provided by the heater 54 will then contribute to the fixing after one rotation of the film 51. For this reason, in the first embodiment, the period corresponding to one rotation of the film 51 and the pressure roller 53 is provided before the leading edge of the following sheet enters the fixing nip portion N. By contrast, in a configuration with a process speed lower than a certain degree, the heat provided by the heater 54 to the inner surface of the film 51 reaches the outer surface of the film 51 before the heated location of the film 51 passes through the fixing nip portion N. In such a configuration, it may not be necessary to provide the period corresponding to one rotation of the film 51 and the pressure roller 53 before the leading edge of the following sheet enters the fixing nip portion N. In that case, productivity can be increased by correspondingly reducing the sheet interval. As above, in the first embodiment, multiple heat generation members 54*b* are provided, and the heat generation member 54*b* is switched during continuous printing. In this configuration, the operation of switching the heat generation member 54*b* is started in the margin area at the trailing edge of the preceding sheet. This enables increased productivity while preventing fixation failures on the preceding sheet.

Thus, according to the first embodiment, reduction in productivity can be prevented in the operation of switching the power supply path to the heat generation member.

Second Embodiment

In the configuration of the image forming apparatus in a second embodiment, components similar to those in the first embodiments will be labeled with the same symbols and will not be described. In the second embodiment, again, the operation of switching the heat generation member 54*b* is started while the preceding sheet is being held by and conveyed through the fixing nip portion N. In particular, in the image forming apparatus in the second embodiment, the timing of starting the operation of switching the heat generation member 54*b* depends on a non-image formation area below the printed image data. Image data on a printed image is transferred from the PC 110 to the video controller 91, which converts the image data into video data instructing to emit or not to emit laser light from the exposure device 11, and stores the video data in memory (not shown). Based on the stored image data read from the memory, the video controller 91 proactively determines the length of the non-image formation area below where no laser light emission is instructed, and notifies the engine controller 92 of the length. From the received length of the non-image formation area below the image data, the engine controller 92 determines the timing of the operation of switching the heat generation member 54*b*.

[Heat Generation Member Switching Operation]

Figure 7A:
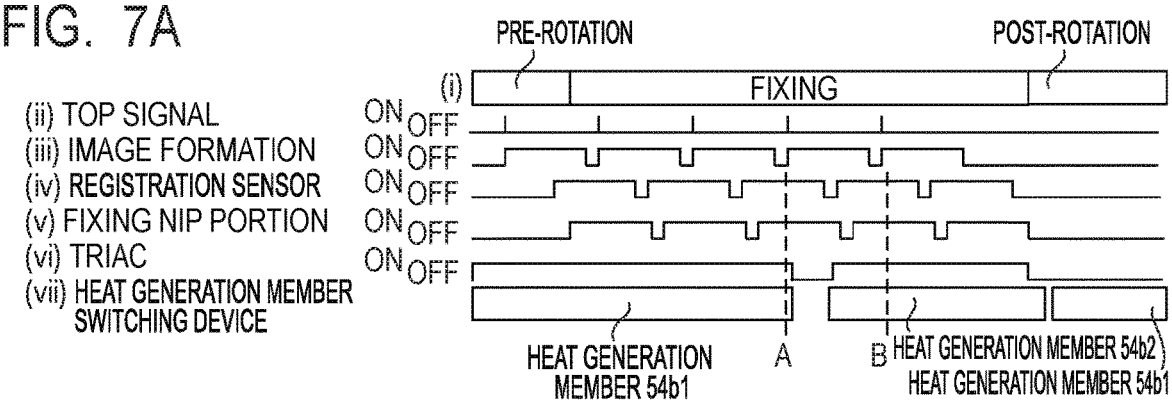
FIGS. 7A, 7B, 7C and 7D are timing charts of the heat generation member switching control in the second embodiment.
Figure 7B:
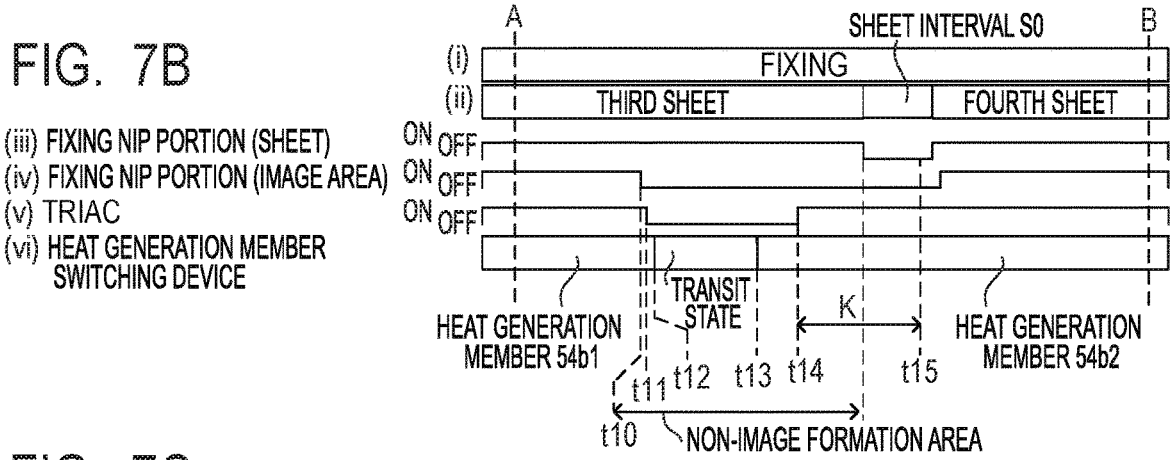
Figure 7C:
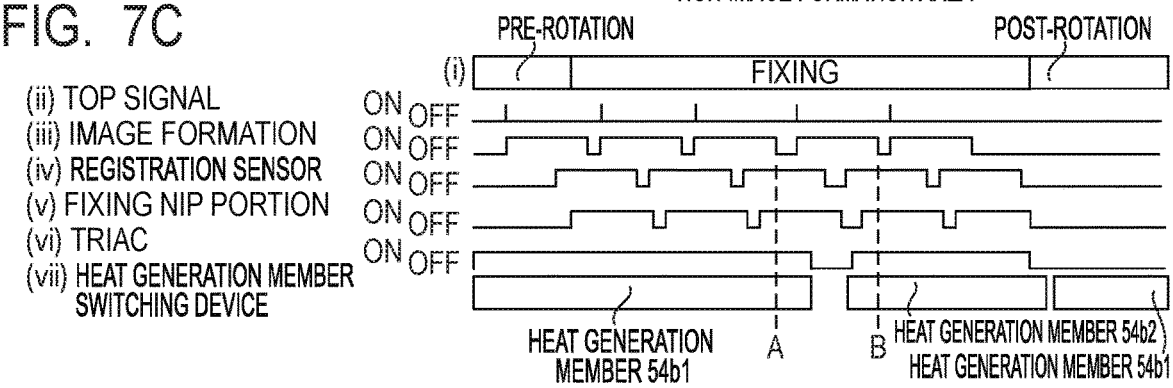
Figure 7D:
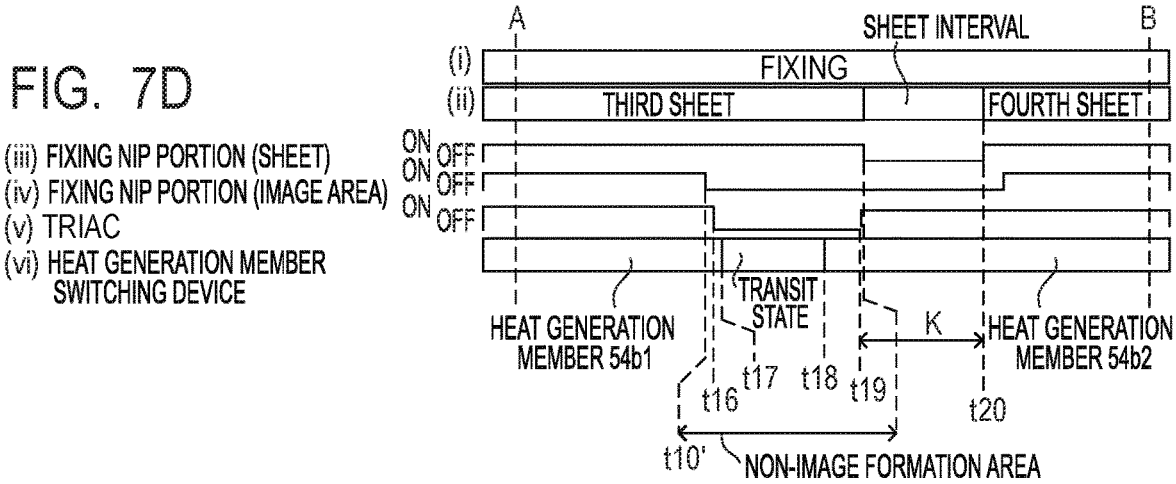
Figure 8:
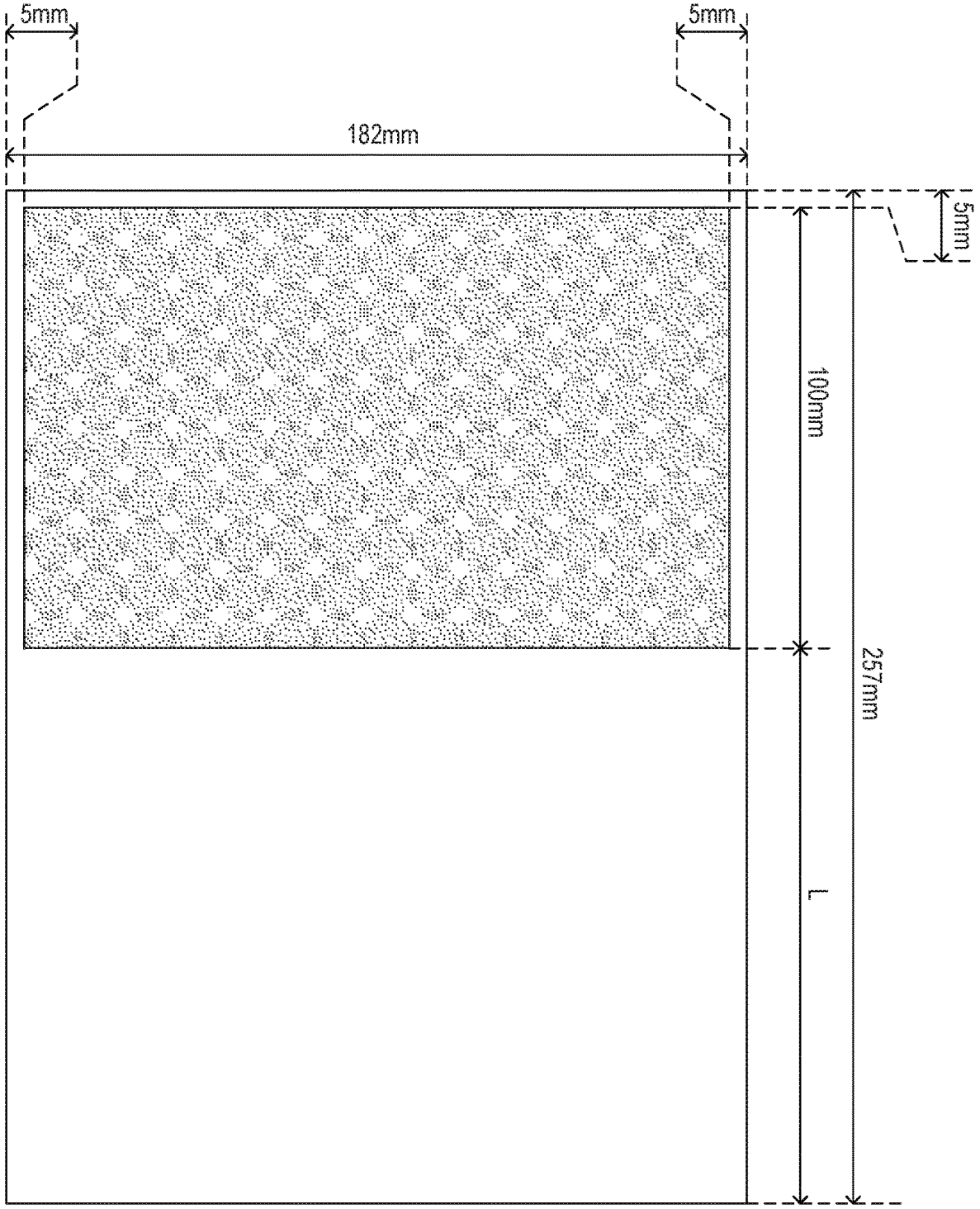
FIG. 8 is a diagram for describing a printed image in the second and third embodiments.

With reference to FIGS. 7A to 7D, details of the heat generation member switching operation in the second embodiment will be described in the example of continuous printing on five B5 sheets that are small-size sheets. FIGS. 7A to 7D are timing charts of continuous printing on five small-size sheets. In FIG. 7A, (i) to (vii) are similar to (i) to (vii) in FIG. 6A and therefore will not be described. In FIG. 7B, (i) to (vi) are similar to (i) to (vi) in FIG. 6B and therefore will not be described. As in the first embodiment, in continuous printing on four or more small-size sheets, the heat generation member 54*b* is switched from the heat generation member 54*b*1 to the heat generation member 54*b*2 between the third and fourth sheets in the second embodiment. FIG. 8 is a diagram illustrating the image on the third sheet printed in this continuous print job.

The area on a sheet P where an image is formed (hereinafter referred to as an image formation area) is, in the conveyance direction of the sheet P, the area except the margin areas at the leading and trailing edges of the sheet P.

In the direction orthogonal to the conveyance direction, the image formation area is the area except the margin areas at the left and right edges of the sheet P. For example, assume that the margin areas of a sheet P are 5 mm from all the leading, trailing, right, and left edges. Then, the image formation area on the sheet P in the conveyance direction is an area from the end of the margin area at the leading edge of the sheet P to the start of the margin area at the trailing edge of the sheet P.

As shown in FIG. 8, the image printed on the third small-size sheet has image data up to 100 mm from the upper end of the image (in other words, 105 mm from the leading edge of the sheet P). From the position at 100 mm from the upper end of the image, a white image (a non-image formation area) extends for 147 mm to the trailing end of the image formation area (or for 152 mm to the trailing edge of the sheet P). This length 152 mm from the end of the image data to the trailing edge of the sheet P will be referred to as the length L of the non-image formation area in the conveyance direction. The trailing end of the image shown in FIG. 8 printed on the third sheet P passes through the fixing nip portion N when the state in (iv) in FIG. 7B transitions from ON to OFF (time t10).

In the second embodiment, as shown in FIG. 7B, the power supply to the heat generation member 54*b*1 is stopped with the triac 56 at time t11. Time t11 is a time point after the position at 105 mm from the leading edge of the third sheet P reaches the most downstream position of the fixing nip portion N (after time t10). At time t12, which is 20 ms after time t11, the CPU 94 sends a signal for switching the heat generation member 54*b* to the heat generation member switching device 57. At time t13, which is 200 ms after time t12, the heat generation member switching device 57 finishes switching from the heat generation member 54*b*1 to the heat generation member 54*b*2. At time t14, which is at least 100 ms after time t13, power supply to the heat generation member 54*b*2 is started with the triac 56. Thus, as in the first embodiment, the switching distance I from time t11 to time t14 is 32 mm in the second embodiment.

At time t15, one of the film 51 and the pressure roller 53 with a longer outer periphery finishes one rotation from time t14. After time t15 and after the trailing edge of the third sheet P passes through the fixing nip portion N, the conveyance of the sheet P is controlled as follows. The leading edge of the fourth sheet P, which is the following sheet, is controlled to enter the fixing nip portion N after a waiting period corresponding to 30 mm, which is a sheet interval S0. In the second embodiment, the outer periphery K of the pressure roller 53 is longer than the outer periphery M of the film 51. The distance 30 mm of the sheet interval between the trailing edge of the preceding sheet and the leading edge of the following sheet is the minimum sheet interval S0 that can be set in the configuration of the image forming apparatus and the fixing device in the first embodiment (hereinafter referred to as the minimum sheet interval).

To perform printing with the minimum sheet interval S0 of the image forming apparatus in the second embodiment, the relationship $L-I+S0 \geq K$ needs to hold among the length L of the non-image formation area in the conveyance direction, the switching distance I (=32 mm), and the outer periphery K of the pressure roller 53 (20 mm$\times\pi\approx$62.8 mm). That is, in the second embodiment, printing can be performed in the shortest time if the length L of the non-image formation area in the conveyance direction is such that L 64.8 mm (=K+I−S0=62.8 mm+32 mm−30 mm).

(If the length L of the non-image formation area in the conveyance direction is long)

In the second embodiment, as in the image in FIG. 8, the length L (=152 mm) of the non-image formation area below in the conveyance direction is longer than 64.8 mm. That is, the above-described relationship holds. Therefore, even with the minimum sheet interval S0 of the image forming apparatus, the film 51 and the pressure roller 53 can be heated longer than a period corresponding to one rotation before the leading edge of the following sheet enters the fixing nip portion N. Consequently, image degradation due to a decrease in the temperature of the film 51 and the pressure roller 53 during the operation of switching the heat generation member 54*b* can be prevented.

(If the length L of the non-image formation area in the conveyance direction is short)

By contrast, if the length L of the non-image formation area below the image in the conveyance direction is shorter than 64.8 mm, the sheet interval S is extended (S>S0) so that the difference between the length L of the non-image formation area in the conveyance direction and the switching distance I equals the outer periphery K of the pressure roller 53 (L−I=K). FIG. 7C is a timing chart in the case where the sheet interval S needs to be extended. FIG. 7D is a detailed timing chart of the heat generation member switching operation in this case. In FIG. 7C, (i) to (vii) are similar to (i) to (vii) in FIG. 6A and therefore will not be described. In FIG. 7D, (i) to (vi) are similar to (i) to (vi) in FIG. 6B and therefore will not be described.

As shown in FIG. 7C, if the length L of the non-image formation area of the printed image in the conveyance direction is shorter than 64.8 mm, control is performed as follows. At the point of starting the image forming operation for the image corresponding to the third sheet P in the first station, the CPU 94 needs to have determined whether the sheet interval S should be extended, i.e., whether the length L of the non-image formation area below the image in the conveyance direction is not shorter than 64.8 mm. If shorter, the CPU 94 adjusts the sheet interval S between the third and fourth sheets by delaying the image forming operation for the fourth sheet.

Details of the heat generation member switching operation will be described with reference to FIG. 7D. The power supply to the heat generation member 54*b*1 is stopped with the triac 56 at time t16. Time t16 is a time point after the non-image formation area in the lower portion of the third sheet P reaches the most downstream position of the fixing nip portion N (after time t10'). At time t17, which is 20 ms after time t16, the CPU 94 sends a signal for switching the heat generation member 54*b* to the heat generation member switching device 57. At time t18, which is 200 ms after time t17, the heat generation member switching device 57 finishes switching from the heat generation member 54*b*1 to the heat generation member 54*b*2. At time t19, which is at least 100 ms after time t18, power supply to the heat generation member 54*b*2 is started with the triac 56. At time t20, at which one of the film 51 and the pressure roller 53 with a shorter outer periphery (in the second embodiment, the pressure roller 53 (with the outer periphery K)) finishes one rotation from time t19, the leading edge of the following sheet enters the fixing nip portion N. In this manner, although the output time is not so short as the minimum output time possible in the second embodiment, higher productivity than in conventional cases can still be provided.

As described above, in the second embodiment, multiple heat generation members 54*b* are provided, and the heat generation member 54*b* is switched during continuous printing. In this configuration, if the image data of a printed image indicates that a non-image formation area exists below the image, control is performed as follows. The operation of switching the heat generation member 54*b* is started when the start point of the non-image formation area reaches the fixing nip portion N. This reduces the necessity to extend the sheet interval S for switching the heat generation member 54*b*, thereby enabling increased productivity.

Thus, according to the second embodiment, reduction in productivity can be prevented in the operation of switching the power supply path to the heat generation member.

Third Embodiment

In the configuration of the image forming apparatus employed in a third embodiment, components similar to those in the first embodiment will be labeled with the same symbols and will not be described. In the third embodiment, again, the operation of switching the heat generation member 54*b* is started while the preceding sheet is being held by and conveyed through the fixing nip portion N. In particular, the third embodiment is characterized in that the operation of switching the heat generation member 54*b* is performed when the toner image T on the sheet P is in the fixing nip portion N. Specifically, the operation of switching the heat generation member 54*b* is started at a position upstream from the lowest end of the printed image data by 56.5 mm (≈18 mm×π), which corresponds to the outer periphery of the film 51 (the member with the shorter outer periphery).

In the configuration with rubber layers on the film 51 or on the pressure roller 53 as described for FIG. 3, the rubber layers function as thermal storage layers. Therefore, even after the power supply to the heat generation member 54*b* is stopped, the fixing device 50 can supply, to the sheet P, a sufficient amount of heat to fix the toner image T on the sheet P during one rotation of the film 51 and the pressure roller 53. Also, in the image forming apparatus with a fast process speed as in the third embodiment, the amount of heat supplied by the heat generation member 54*b* to the inner surface of the film 51 in the fixing nip portion N reaches the outer surface of the film 51 after the heated portion passes through the fixing nip portion N. For these reasons, in the lower portion of the sheet P, the area corresponding to one rotation of the film 51 and the pressure roller 53 is less subject to fixing errors even if the power supply to the heat generation member 54*b* is stopped. As such, in the third embodiment, the operation of switching the heat generation member 54*b* is started at a position moved toward (closer to) the upper end of the image by the distance corresponding to one rotation of the member with the shorter outer periphery from the trailing end of the image.

In the third embodiment, as in the second embodiment, image data on a printed image is transferred from the PC 110 to the video controller 91, which calculates the length L of the non-image formation area below the image data in the conveyance direction and sends the length L to the engine controller 92. Based on the length L of the non-image formation area below in the conveyance direction received from the video controller 91, the engine controller 92 determines the timing of the operation of switching the heat generation member 54*b*.

[Heat Generation Member Switching Operation]

Figure 9A:
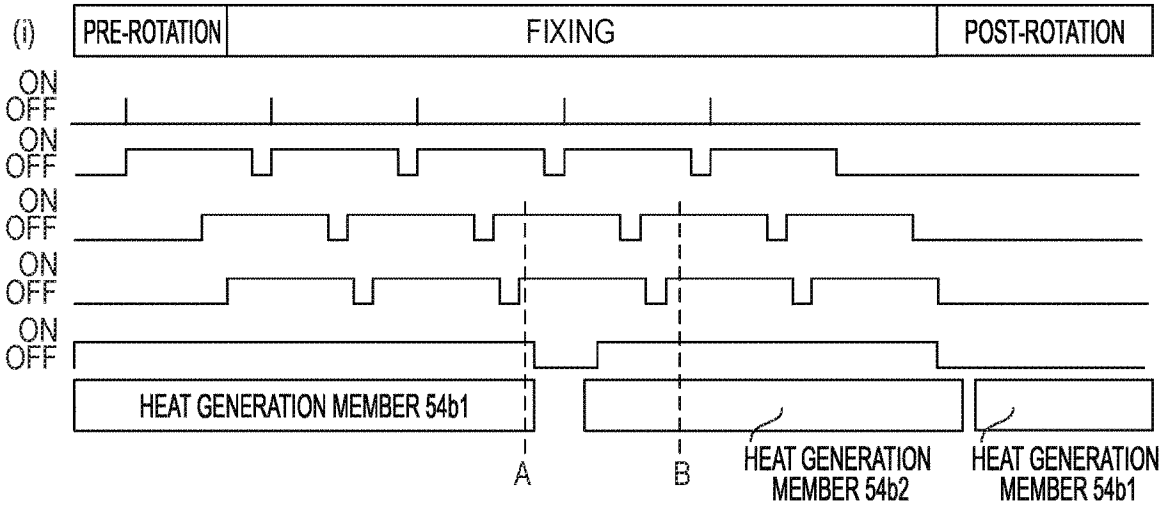
FIGS. 9A and 9B are timing charts of the heat generation member switching control in the third embodiment.
Figure 9B:
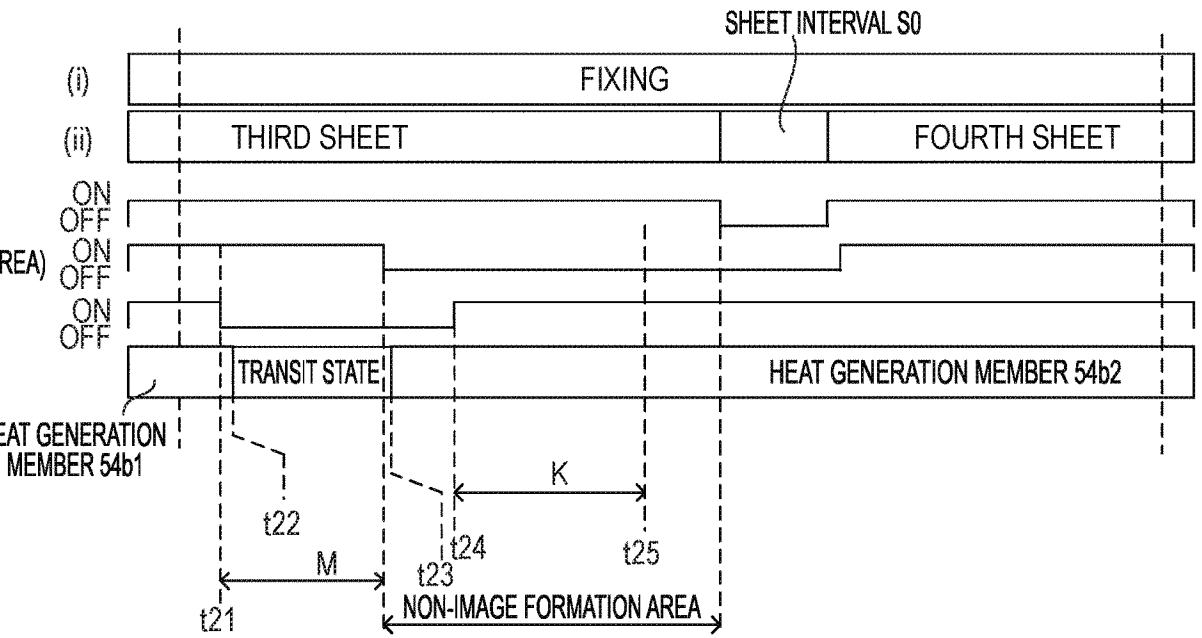

With reference to FIGS. 9A and 9B, details of the operation of switching the heat generation member 54*b* in the third embodiment will be described in the example of continuous printing on five B5 sheets that are small-size sheets. FIGS. 9A and 9B are timing charts of continuous printing on five small-size sheets. In FIG. 9A, (i) to (vii) are similar to (i) to (vii) in FIG. 6A and therefore will not be described. In FIG. 9B, (i) to (vi) are similar to (i) to (vi) in FIG. 6B and therefore will not be described. As in the second embodiment, in continuous printing on four or more small-size sheets, the heat generation member 54*b* is switched from the heat generation member 54*b*1 to the heat generation member 54*b*2 between the third and fourth sheets in the third embodiment. The printed image in the third embodiment is the same as the printed image in the second embodiment shown in FIG. 8.

In the third embodiment, the power supply to the heat generation member 54*b*1 is stopped with the triac 56 at time t21. Time t21 is a time point at which the position at 48.5 mm from the leading edge of the third sheet P reaches the most downstream position of the fixing nip portion N. The distance 48.5 mm results from subtracting the outer periphery M (≈56.5 mm) of the film 51 from the distance 105 mm from the leading edge of the sheet P to the end of the image data (=105 mm−56.5 mm). At time t22, which is 20 ms after time t21, the CPU 94 sends a signal for switching the heat generation member 54*b* to the heat generation member switching device 57. At time t23, which is 200 ms after time t22, the heat generation member switching device 57 finishes switching from the heat generation member 54*b*1 to the heat generation member 54*b*2. At time t24, which is at least 100 ms after time t23, power supply to the heat generation member 54*b*2 is started with the triac 56. At time t25, the pressure roller 53 finishes one rotation from time t24. After time t25 and when the period corresponding to 30 mm elapses after the trailing edge of the third sheet P passes through the fixing nip portion N, the leading edge of the following sheet enters the fixing nip portion N.

To perform printing with the minimum sheet interval S0 of the image forming apparatus in the third embodiment, the relationship L−I+M+S0 K needs to hold among the length L of the non-image formation area in the conveyance direction, the switching distance I (=32 mm), the outer periphery K of the pressure roller 53, and the outer periphery M of the film 51. In the third embodiment, printing can be performed in the shortest time if L 8.3 mm (=K+I−M−S0=62.8 mm+32 mm−56.5 mm−30 mm). Thus, printing can be performed with the minimum output time even if the length L of the non-image formation area in the conveyance direction is short.

(If the length L of the non-image formation area in the conveyance direction is long)

In the third embodiment, as in the image in FIG. 8, the length L of the non-image formation area below in the conveyance direction is longer than 8.3 mm (L=152 mm). Therefore, even with the minimum sheet interval S0 of the image forming apparatus, the film 51 and the pressure roller 53 can be heated longer than a period corresponding to one rotation before the leading edge of the following sheet enters the fixing nip portion N. Consequently, image degradation due to a decrease in the temperature of the film 51 and the pressure roller 53 during the operation of switching the heat generation member 54*b* can be prevented.

(If the length L of the non-image formation area in the conveyance direction is short)

By contrast, if the length L of the non-image formation area in the conveyance direction is shorter than 8.3 mm, the sheet interval S is extended so that the difference between "the sum of the length L of the non-image formation area in the conveyance direction and the outer periphery M of the film 51" and "the switching distance I" equals the outer periphery K of the pressure roller 53 (L+M−I=K). In this manner, although the output time is not so short as the minimum output time possible in the third embodiment, higher productivity than in conventional cases can still be provided.

As described above, in the third embodiment, multiple heat generation members 54*b* are provided, and the heat generation member 54*b* is switched during a continuous job. In this configuration, control is performed as follows. Based on the image data on the printed image, the operation of switching the heat generation member 54*b* is started at a position located 56.5 mm, which corresponds to the outer periphery M of the film 51, upstream from the lowest end of the printed image data. That is, the switching operation is performed when the position upstream from the trailing end of the image by the distance of the outer periphery of one of the film 51 and the pressure roller 53 with a shorter outer periphery is within the fixing nip portion N. This reduces the necessity to extend the sheet interval for switching the heat generation member 54*b*, thereby enabling increased productivity.

Thus, according to the third embodiment, reduction in productivity can be prevented in the operation of switching the power supply path to the heat generation member.

According to the present invention, reduction in productivity can be prevented in the operation of switching the power supply path to the heat generation member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-053036, filed Mar. 20, 2019, which is hereby incorporated by reference herein in its entirety.

What is claimed is:

1. A fixing device comprising:

a heater having at least a first heat generation member and a second heat generation member whose length in a longitudinal direction shorter than the first heat generation member;

a first rotary member configured to be heated by the heater;

a second rotary member configured to form a nip portion together with the first rotary member;

a switching unit configured to switch a power supply path for supplying power to the first heat generation member or the second heat generation member; and a first control unit configured to control the switching unit, wherein the fixing device is configured so that an unfixed toner image borne on a recording material is fixed with heat in the nip portion while the recording material passes through the nip portion, wherein in continuous printing on a first recording material whose length in the longitudinal direction is shorter than the second heat generation member, during a period when the first recording material is nipped in the nip portion, the first control unit controls the switching unit to start switching operation of switching the power supply path so that power is supplied to the second heat generation member.

2. A fixing device according to claim 1, comprising a connection unit configured to supply power or cut off supply of the power from an AC power supply to the first heat generation member or the second heat generation member, wherein the first control unit controls the switching unit to perform the switching operation in a state where the connection unit cuts off the supply of power to the first heat generation member or the second heat generation member.

3. A fixing device according to claim 2, wherein the first control unit controls the switching unit to start the switching operation after a start position of a margin area on a side of a trailing edge of the first recording material in a conveyance direction reaches the nip portion.

4. A fixing device according to claim 2, wherein the first control unit controls the switching unit to start the switching operation after a trailing end of a printed image printed on the first recording material in a conveyance direction reaches the nip portion.

5. A fixing device according to claim 4, comprising a second control unit configured to determine the trailing end of the image in the conveyance direction based on input image data, wherein the second control unit sends information on the trailing end to the first control unit.

6. A fixing device according to claim 5, wherein in a case where a length from the trailing end of the printed image to a trailing edge of the first recording material in the conveyance direction is a predetermined length or longer, the first control unit controls a sheet interval to be a shortest sheet interval capable of being set for the fixing device, the sheet interval being defined as a distance from at a position where the trailing edge of the first recording material passes through the nip portion to a position where a leading edge of a second recording material entering the nip portion following the first recording material reaches the nip portion, and wherein in a case where the length from the trailing end of the printed image to the trailing edge of the first recording material in the conveyance direction is shorter than the predetermined length, the first control unit performs control so that the leading edge of the second recording material reaches the nip portion after one of the first rotary member and the second rotary member, the one having a longer outer periphery, rotates with one revolution from a time when the connection unit starts supply of power to the second heat generation member after the switching unit finishes the switching operation.

7. A fixing device according to claim 2, wherein the first control unit controls the switching unit to start the switching operation after a position with a certain distance upstream in a conveyance direction from a trailing end of a printed image printed on the first recording material in the conveyance direction reaches the nip portion, the certain distance being defined as a length of a shorter one of outer peripheries of the first rotary member and the second rotary member.

8. A fixing device according to claim 3, wherein the first control unit performs control so that a leading edge of a second recording material entering the nip portion following the first recording material reaches the nip portion after one of the first rotary member and the second rotary member, the one having a longer outer periphery, rotates with one revolution from a time when the connection unit starts supply of power to the second heat generation member after completion of the switching operation.

9. A fixing device according to claim 1, wherein after printing on a specified number of sheets of the first recording material is finished, the first control unit controls the switching unit to perform the switching operation so that power is supplied to the first heat generation member.

10. A fixing device according to claim 1, wherein in continuous printing on the first recording material, the first control unit performs fixing by the first heat generation member, up to a predetermined number of sheets of the first recording material.

11. A fixing device according to claim 1, wherein in continuous printing on a third recording material whose length in the longitudinal direction is longer than the second heat generation member, the first control unit performs fixing by the first heat generation member.

12. A fixing device according to claim 1, wherein the first rotary member is a film.

13. A fixing device according to claim 12, wherein the heater is provided to be in contact with an inner surface of the film, and wherein the nip portion is formed by the heater and the second rotary member through the film.

14. An image forming apparatus comprising:

an image forming unit configured to form an unfixed toner image on a recording material; and a fixing device according to claim 1 configured to fix the unfixed toner image on the recording material.

* * * * *